US005203412A

United States Patent [19]

Doggett

[11] Patent Number: 5,203,412

[45] Date of Patent: Apr. 20, 1993

[54] WELL COMPLETION TOOL

[76] Inventor: Glenn Doggett, P.O. Box 712, Water Valley, Tex. 76958

[21] Appl. No.: 711,458

[22] Filed: Jun. 6, 1991

Related U.S. Application Data

[63] Continuation-in-part of Ser. No. 557,614, Jul. 24, 1990, abandoned.

[51] Int. Cl.[5] ..... E21B 23/04

[52] U.S. Cl. ..... 166/186; 166/187; 166/191; 166/328

[58] Field of Search ..... 166/186, 191, 312, 183, 166/129, 187, 332, 285

[56] References Cited

U.S. PATENT DOCUMENTS

| | | | |
|---|---|---|---|
| 2,824,612 | 2/1958 | Lynes | 166/191 |
| 3,071,193 | 1/1963 | Raulins | 166/332 |
| 3,456,725 | 7/1969 | Hateh | 166/186 |
| 3,865,188 | 2/1975 | Doggett et al. | 166/285 |
| 3,948,322 | 4/1976 | Baker | 166/289 |
| 4,560,005 | 12/1985 | Helderle et al. | 166/332 |
| 4,815,538 | 3/1989 | Burroughs | 166/191 |
| 5,012,871 | 5/1991 | Pleasants et al. | 166/191 |

*Primary Examiner*—Ramon S. Britts
*Assistant Examiner*—Frank S. Tsay
*Attorney, Agent, or Firm*—Arthur F Zobal

[57] ABSTRACT

The completion tool is formed by two identical inflation valve bodies, two identical casing members screwed to the two valve bodies respectively, two identical packer mandrels with packers coupled to said inflation valve bodies, and a valve sleeve coupled to the other ends of the two casing members and to the two packer mandrels. A piston is slidably located in the sleeve valve for movement between opened and closed positions. One casing, with its valve body and packer mandrel and packer is screwed to one end of the sleeve valve and the other casing with its valve body and packer mandrel and packer is coupled to the other end of the sleeve valve by way of an adapter coupling. The packers are bonded in annular slots formed in the packer mandrels at opposite ends to allow the packers to be expanded outward. Valve structure is provided in the valve bodies for allowing the packers to be inflated. A central passageway and outer by-pass passageway are formed through the completion tool. The piston has ports formed therethrough which are in fluid communication with ports formed through the sleeve valve when the piston is in its open position for providing a flow path from the outside of the tool to the inside by way of the ports and the piston. The inside of the sleeve valve carries spring biased detents which engage upper and lower slots for releasably holding the piston in its closed and open positions, controlling the shifting force of the piston.

22 Claims, 11 Drawing Sheets

CA
31
61U
62
41UA
51U
105
43
101U
103
41U
42
119
83
82
87R
78R
77R
91
76R
46
48
44
43
50
101UA
119
45
47

41UB
10UB
257W
257U
147
131U
141U
253
131
251
241
235
237
229
221
47
49
121
49R
105
145
148
307U
251
307L
159
239
255
239
206

WELL COMPLETION TOOL

This application is a continuation-in-part of U.S. Pat. application Ser. No. 07/557,614, filed on Jul. 24, 1990, now abandoned.

FIELD OF THE INVENTION

The invention relates to a well borehole tool for all types of wells such as oil, gas, thermal and disposal wells having two packers for isolating a selected zone in the borehole.

DESCRIPTION OF THE PRIOR ART

U.S. Pat. No. 3,865,188 discloses a completion tool that has been used in the past. Although this tool is useful it has certain disadvantages.

SUMMARY OF THE INVENTION

It is an object of the invention to provide a new and useful completion tool having two packer mandrels with packers, two inflation valve bodies for inflating the packers respectively and an intermediate sleeve valve with a piston for opening and closing a port, each component of which employs unique features.

In one aspect, the packer mandrels with their packers are identical, one of which is coupled to one end of the sleeve valve and the other of which is coupled to the other end of the sleeve valve by way of an adapter coupling member.

In a further aspect, the ends of the packers are bonded to their mandrels for simple and effective construction.

In another aspect, the inflation valve bodies are identical, one of which is coupled to an end of one packer mandrel and the other of which is coupled to an end of the other packer mandrel.

The inflation valve bodies each is machined from a single piece of metal, making construction simple and effective. They also serve as centralizers for the tool.

In another aspect of the invention, the sleeve valve comprises two subs connected together by an inner coupling member for supporting the piston for sliding movement. The inner coupling member supports two spaced apart seals between which are formed, through the inner coupling member, production ports which are opened or closed by the piston.

In a further aspect of the invention, one of the subs supports detents for holding the piston in its open or closed position.

In the embodiment disclosed, the ends of the two subs are connected to ends of two casing members which are located in the inside of the packer mandrels and the other ends of the casing members are connected to the two inflation valve bodies respectively. A central flow path extends through the tool.

The sleeve valve fits within an outer body means and slots are machined in exterior portions of the inflation valve bodies, the two subs, and the adapter coupling member and inner coupling member for providing an outer flow path for cement from below the lower packer to above the upper packer.

In a further aspect of the invention, the components of the tool are constructed such that the tool can be easily assembled by fitting and screwing the components together.

It is a further object of the invention to provide an extension member which readily can be connected to either end of the sleeve valve to extend the distance between the packers.

In another embodiment of the invention the sleeve valve comprises an elongated member through which the production ports are formed, and two end coupling members. The detents are supported by the elongated member. An annular slot is formed on the inside of the elongated member which is in fluid communication with the production ports.

Figure 14:
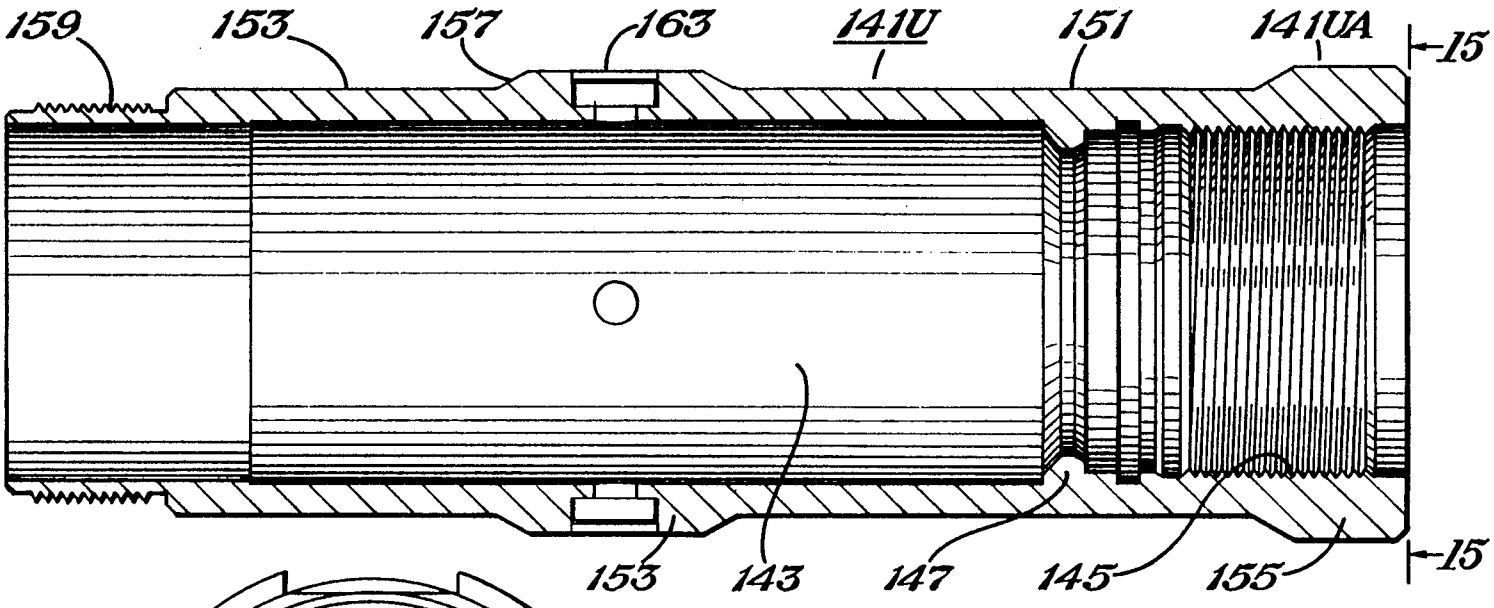
FIG. 14 is an enlarged cross section of the upper sub of the completion tool.

15 is an enlarged end view of the upper sub of FIG. 14 taken along lines 15-15 thereof.

Figure 16:
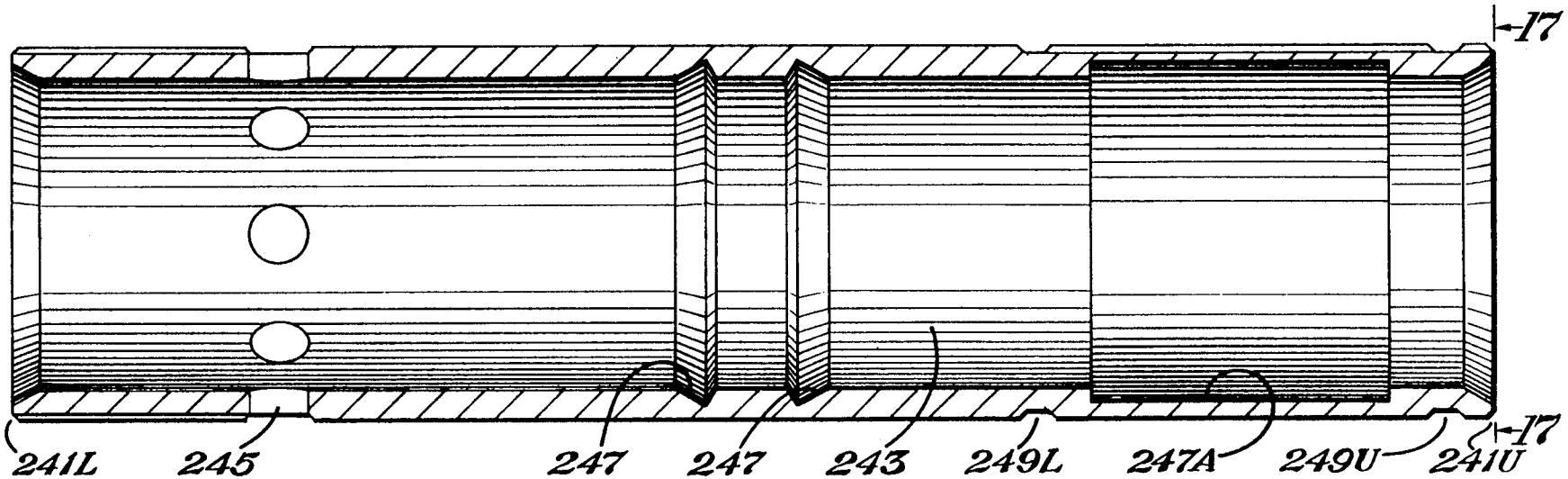

FIG. 16 is an enlarged cross section of the sleeve valve of the completion tool.

Figure 17:
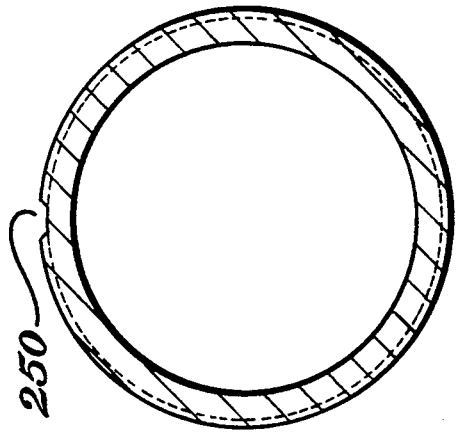

FIG. 17 is an end view of the piston of FIG. 16 taken along the lines 17—17 thereof.

Figure 18:
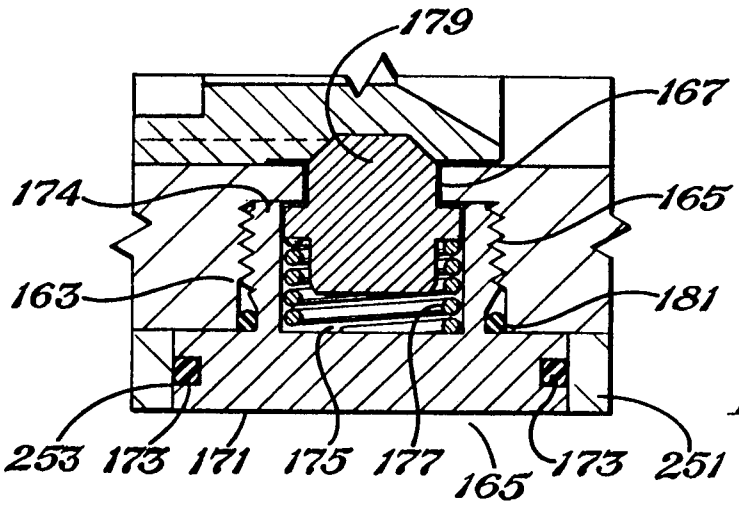

FIG. 18 is an enlarged cross section of one of the detent of the completion tool.

Figure 19:
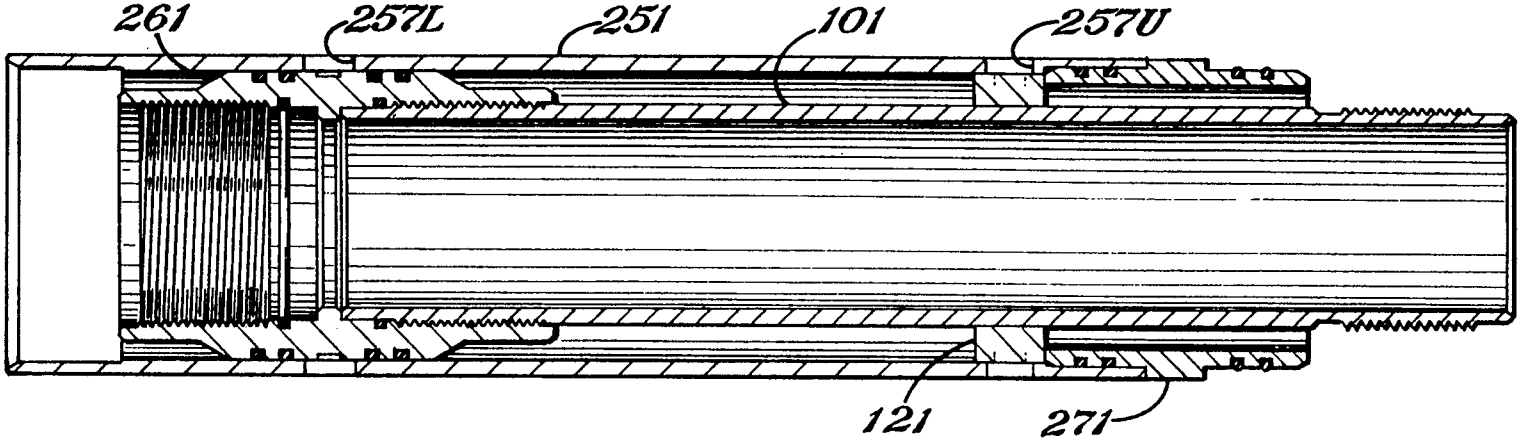

FIG. 19 is a cross section of an extension member which can be used to extend the length of the completion tool between the packers.

Figure 20:
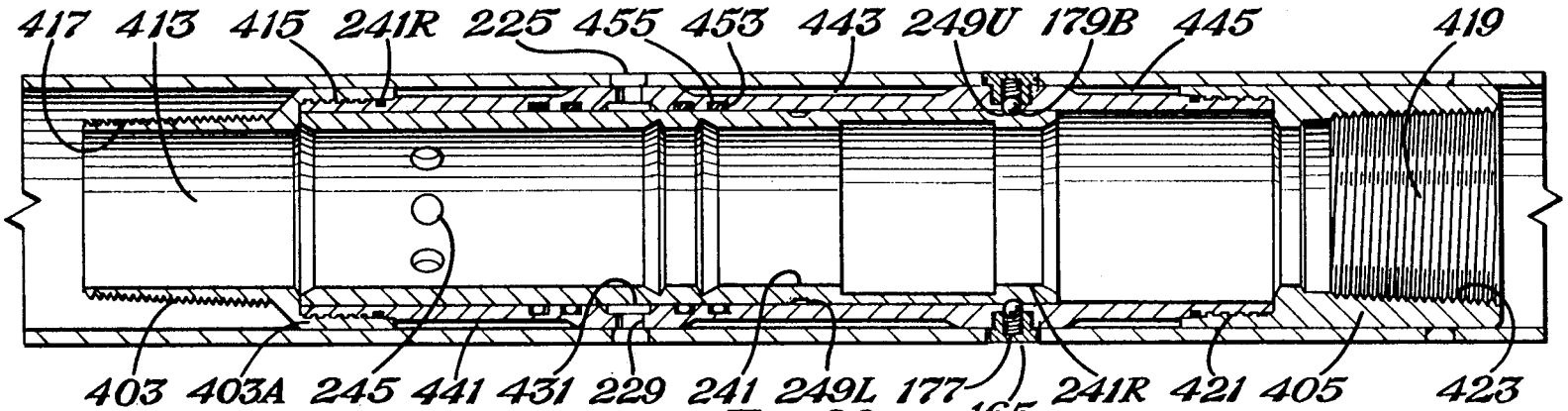

FIG. 20 is a cross-section of another embodiment of the sleeve valve housing of the invention with two end coupling members.

Figure 21:
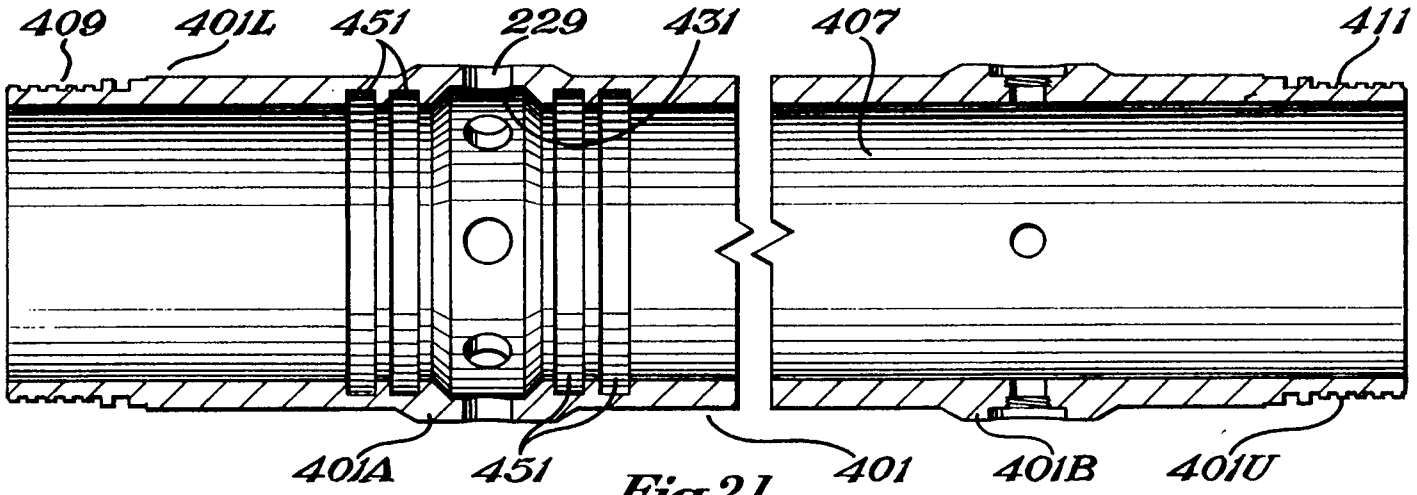

FIG. 21 is an enlarged cross-section of the sleeve valve housing of FIG. 20.

DESCRIPTION OF THE PREFERRED EMBODIMENTS

Referring now to the drawing, the completion tool is identified at 31. It comprises identical upper and lower packer mandrels 41U and 41L having identical packer members 51U and 51L bonded therearound respectively; identical upper and lower inflation valve bodies 61U and 61L coupled to the ends 41UA and 41LA of the mandrels 41U and 41L respectively; and identical upper and lower casing members 101U and 101L located within the mandrels 41U and 41L respectively. The ends 101UA and 101LA are screwed to the inflation valve bodies 61U and 61L respectively.

The ends 41UB and 101UB of the mandrel 41U and casing member 101U are coupled directly to one end 131U of a sleeve valve 131 and the ends 41LB and 101LB of the mandrel 41L and casing member 101L are coupled to the other end 131B of the sleeve valve 131 by way of an adapter coupling member 261. Centralizing rings 121 space apart the ends 41UB and 101UB and the ends 41LB and 101LB of the mandrels and casing members 41U, 101U and 41L, 101L respectively.

The sleeve valve 131 comprises upper and lower subs 141U and 201L coupled together by an inner coupling member 221 for supporting a piston 241 for opening and closing ports 229 and 255 formed through the inner coupling member 221, and through an outer body member 251. Located around the coupling adapter member 261 and the lower end of the sub 201L are a by pass mandrel 281 and a seal ring 271 respectively.

The component parts of the completion tool are fitted and screwed together to form the tool which has a central aperture CA extending therethrough from inflation valve body 61U to inflation valve body 61L and an outer flow path located between the central flow path CA and the outer wall of the tool (and the packers) for the flow of cement from below packer 51L to above packer 51U.

Coupled to the lower end of the valve body 61L is a casing nipple CN. A similar casing nipple will be coupled to the upper end of the valve body 61U to allow the completion tool to be connected to casing tubing to allow the completion tool to be lowered into a borehole formed in the earth to a desired position such that the upper and lower packers 51U and 51L are above and below a desired formation to be produced.

Figure 2:
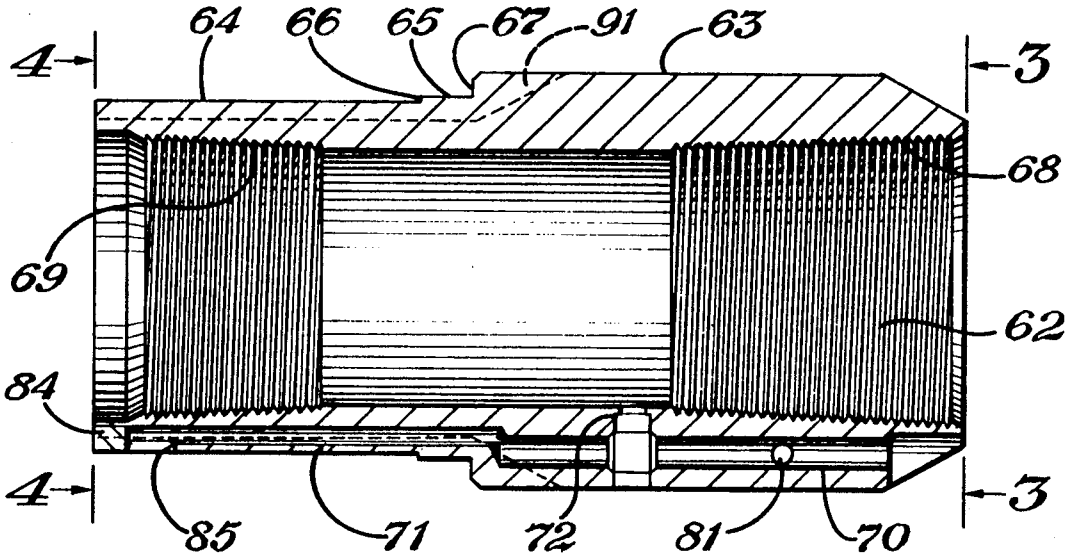
FIG. 2 is an enlarged cross section of an inflation valve body of the completion tool.
Figure 3:
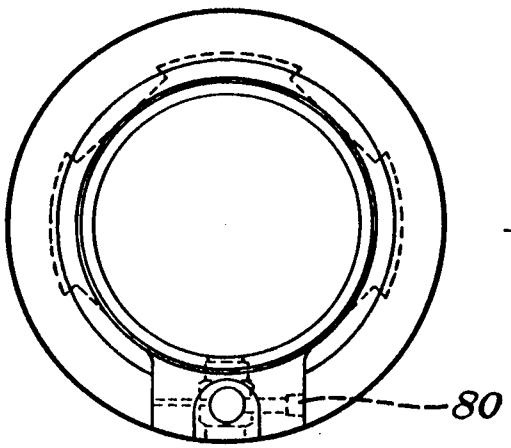
FIG. 3 is an end view of the inflation valve body of FIG. 2 taken along the lines 3—3 thereof.
Figure 4:
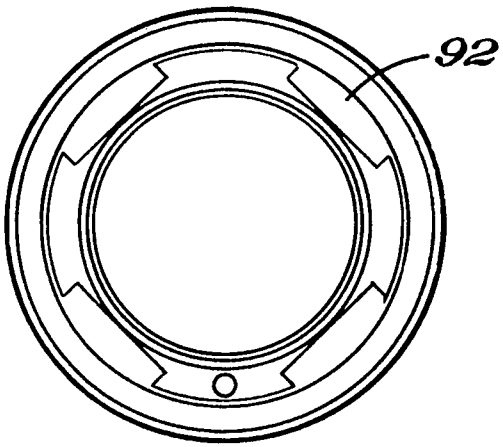
FIG. 4 is an end view of the inflation valve body of FIG. 2, taken along the lines 4—4 thereof.

At this position, the packers 51U and 51L are inflated to engage the wall of the borehole to secure the completion tool in place. Cement then is injected down the central aperture CA of the tool where it flows downward below the packer 51L and through lower structure of the casing tubing and then upward through the outer flow path of the completion tool where it exits above the packer 51U to cement the tool in place with the cement joining the tool to the wall of the borehole above and below the packer 51U and 51L, but isolating the formation of interest such that formation fluids (oil and gas) may flow into the borehole and into the tool through the ports formed through the outer body and through the inner coupling member and the piston when the piston has been moved to its open position and then upward through the central opening CA of the tool to the surface for production purposes Referring now to FIGS. 2–4, there will be described the inflation valve bodies 61U and 61L. Since they are identical, only one will be described and it is identified by reference numeral 61. It is a steel member having a central aperture 62 formed therethrough, a larger outside diameter portion 63 at one end and a smaller outside diameter portion 64 at the other end with a short intermediate outside diameter portion 65 formed between portions 63 and 64. Shoulder 66 separates cylindrical surfaces 64 and 65, and shoulder 67 separates cylindrical surfaces 63 and 65. The outside surfaces of portions 63, 64, and 65 are round. Threads 68 are formed on the inside of portion 63 and threads 69 are formed on the inside of portion 64.

Formed lengthwise through portion 63 is a cylindrical bore 70 and formed lengthwise through portion 64 is a smaller diameter bore 71 which intercepts bore 70. Bores 70 and 71 are parallel to the axis of member 61. A bore 72 extends from the inside of member 61 and intercepts bore 70.

Figure 5:
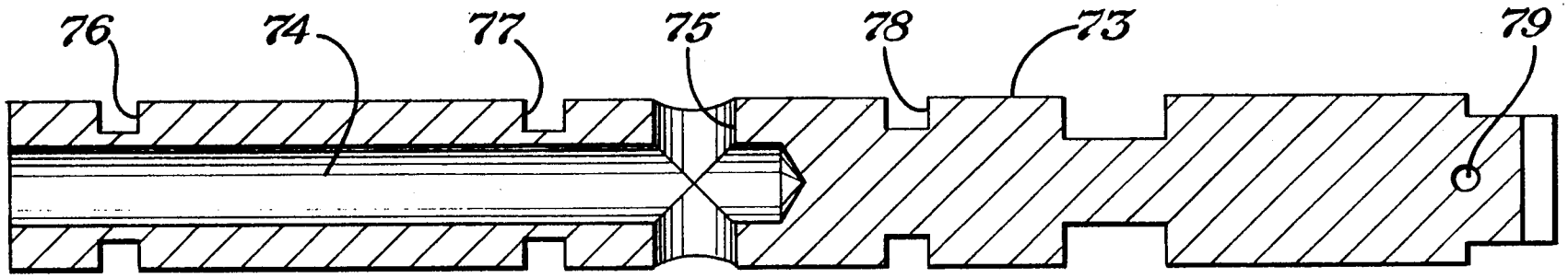
FIG. 5 is an enlarged cross section of the control piston of the inflation valve body of FIG. 2.

A cylindrical piston 73 (see FIG. 5) is located in the bore 70 for sliding movement when released. The piston 73 has an axially formed aperture 74 extending from one end to a transversely formed aperture 75. Spaced apart annular slots 76, 77, and 78 hold resilient O-ring seals 76R, 77R, and 78R respectively.

The other end of the piston 73 has a small diameter transverse aperture 79 formed therethrough from receiving a shear pin 80 which is inserted through apertures 81 on each side of the bore 70 formed through a finned portion which is formed by machining or cutting the enlarged portion 63 of the body 61. A plug 82 is inserted into and welded in the other end of the bore 70. The plug 82 has an aperture 83 formed therethrough exposing the bore 70 to the outside. A plug 84 also is inserted into and welded in the other end of the bore 71. An aperture 85 is formed into the portion 64 which intercepts the bore 71 near the plug 84.

A retainer 86 having an annular slot 87 with a resilient O-ring 87R is inserted into the aperture 72. The retainer 86 has a stem 88 with male threads 89 that is located to the central opening 62 of member 61. An aperture 90 is formed through the retainer and communicates with the apertures 75 and 74 of the piston 73 when it is located in the open position shown in FIG. 1A. A cover 91 having a tubular portion with female threads is screwed to the threads 89 of retainer 86. When the cover 91 is knocked off, a flow path from the central opening 62 to the bore 71 is provided by way of the aperture 90 of retainer 86 and the apertures 74 and 75 of the piston 73. When fluid pressure becomes great enough, as will be described subsequently, the shear pin 80 breaks and the piston 73 is forced against plug 82 such that O-ring seals 76R and 77R are located on opposite sides of apertures 72 and 90 and further flow of fluid pressure through apertures 72 and 90 is blocked by the piston 73.

Four angularly spaced apart slots 92 are machined or cut in the outside of the portion 64 and into a portion of the outside of portion 63 of member 61.

Figures 1A, 1B:
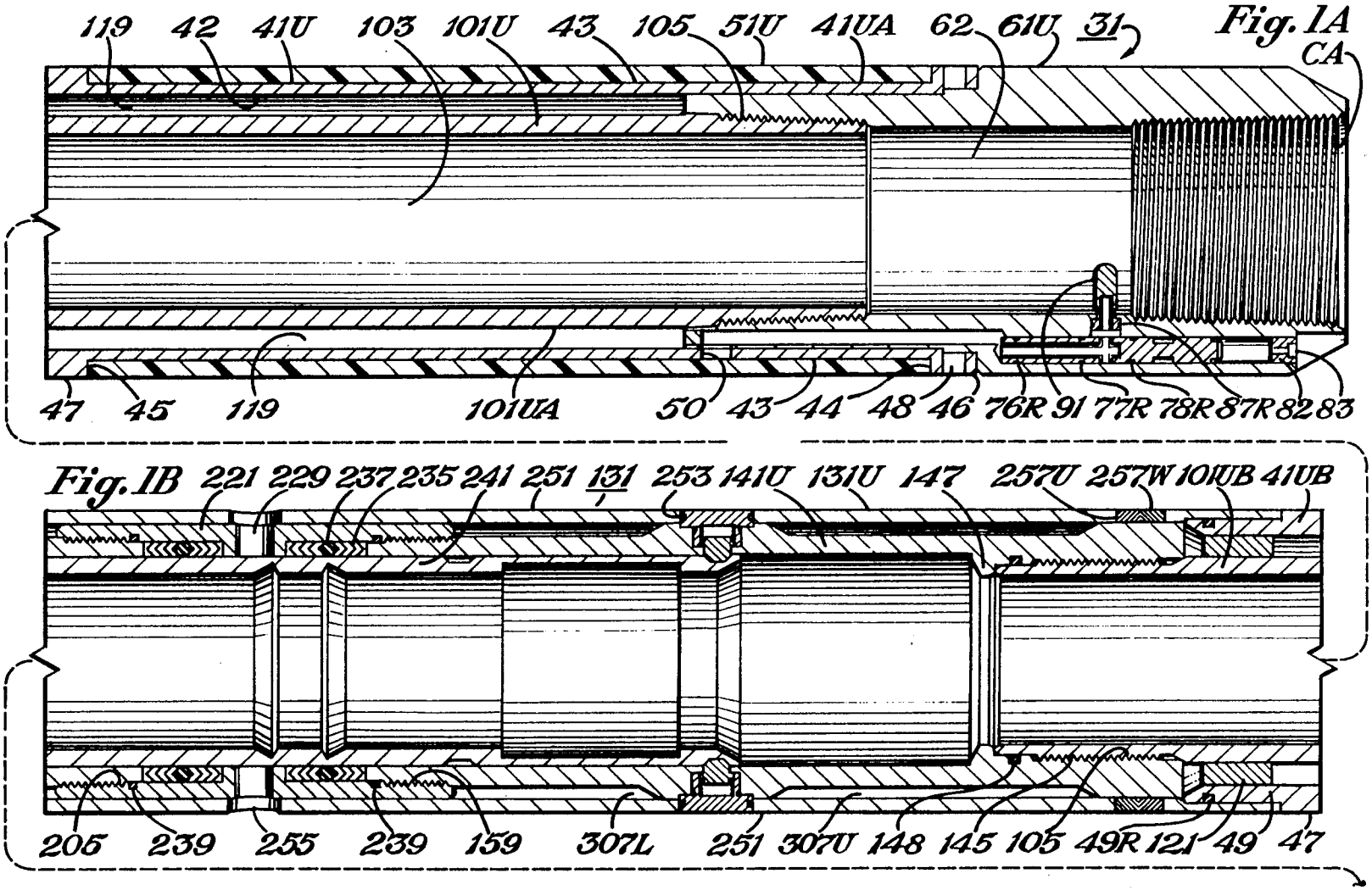
FIGS. 1A-1D illustrate a cross section of the completion tool of the invention. The component in FIG. 1A is the top of the completion tool and the component in FIG. 1D is the bottom of the completion tool.

The casing member 101d 101L are formed of steel and each has a cylindrical outer surface and a cylindrical central opening 103 formed therethrough. Male threads 105 are formed on opposite ends and mate with threads 69 of the inflation valve bodies 61 such that one end of each of the casing members 101U and 101L may be screwed to the threads 69 of each of the inflation valve bodies as shown in FIGS. 1A and 1D.

The packer mandrels 41U and 41L are formed of steel and each has a central opening 42 formed therethrough. An elongated cylindrical shaped annular slot 43 is formed between shoulders 44 and 45 for receiving a packer 51. The ends 46 and 47 are thicker radially. The inside of ends 41UA and 41LA are shaped to mate with surfaces 64, 65, 66 and 67 of the inflation valve bodies 61 such that the ends 41UA and 41LA of the packer mandrels 41U and 41L are supported by the inflation valve bodies 61 when the tool is assembled. The thicker end portions 46 of the packer mandrels 41U and 41L each has four angularly spaced apart apertures 48 formed therethrough which mate with the slots 91 of the inflation valve bodies 61 when the tool is assembled. The ends 41UB and 41LB of the packer mandrels 41U and 41L have cylindrical slots 49 formed therein, in which are formed smaller slots for supporting O-ring seals 49R.

The cylindrical packers 51U and 51L are formed by wrapping elastomer sheets and Kevlar or Nylon fabric sheets alternately around the packer mandrels inside of the annular slots 43 of the packer mandrels 41U and 41L and bonding the elastomer and fabric layers together with heat and bonding or molding the ends of the packers to the surfaces of the mandrels defined by the slots 43 with heat and pressure but leaving the intermediate portions of the packers 51U and 51L unbounded to the mandrel surfaces in the slots 43. The elastomer sheets extend the full lengths of the annular slots 43, and hence the full length of the packers. The fabric sheets have lengths such that they are located only at the bonded ends of the packers whereby the intermediate portions of the packers are free to expand outward. In one embodiment, each of the slots 43 and the packers 51U and 51L was 18 inches long. The edges of the packers were bonded to the shoulders 44 and 45 of the packer mandrels and the inside portions of the packers three inches from each end were bonded to the packer mandrel surfaces inside the slots 43 such that the intermediate twelve inches of the packers were not bonded to the packer mandrel surfaces inside the slots 43. Each end 41UA and 41LA of the packer mandrels has an aperture 50 formed therethrough in communication with the intermediate unbounded packer portions such that fluid can be injected through the apertures 50 to inflate the packers. Apertures 50 are in alignment with apertures 85 of the inflation valve bodies such that the packers may be inflated by knocking the covers 91 off and injecting fluid between the packer mandrels and intermediate unbounded packer portions by way of apertures 72, apertures 74 of the pistons 73 when in their open positions bores 70, apertures 85 of the inflation valve bodies 61U and 61L and apertures 50 of the packer mandrels.

Figure 7:
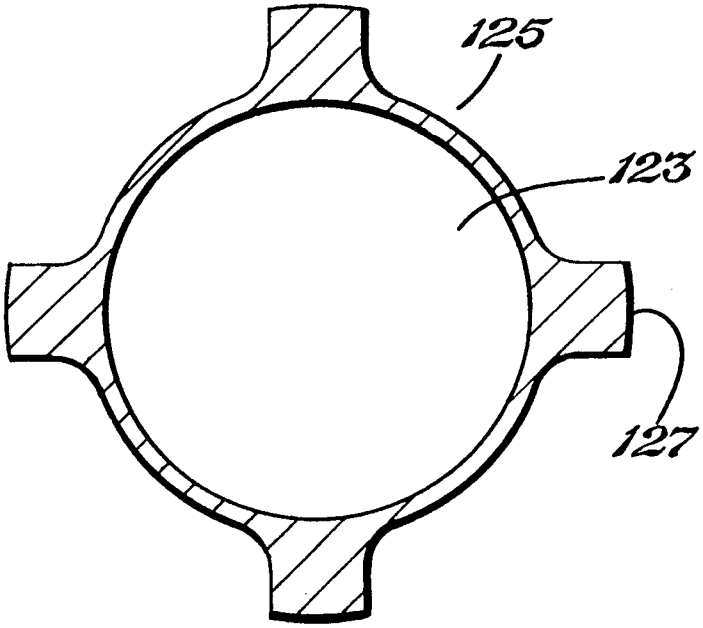
FIG. 7 is a plan view of one of the two centralizing rings used in the completion tool.
Figure 6:
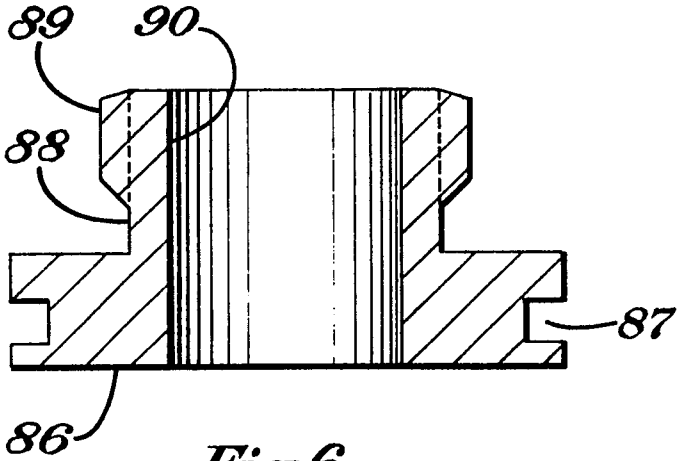
FIG. 6 is an enlarged cross section of the retainer of the pin cover of the inflation valve body of FIG. 2.

In the assembled condition of the completion tool, the ends 41UB and 41LB of the packer mandrels are supported and spaced from the casings 101U and 101L by centralizing rings 121, forming an annulus 119 between each of the casings and packer mandrels each of which is in fluid communication with slots 92 and hence the outside of the tool. As shown in FIG. 7, rings 121 each has a cylindrical opening 123 for receiving the casing 101 and four angularly spaced apart slots 125 machined or cut in its outer cylindrical surface forming four angularly spaced apart spokes 127 for engaging the inside of the packer mandrels. The slots 125 are in fluid communication with the annulus 119.

Figure 15:
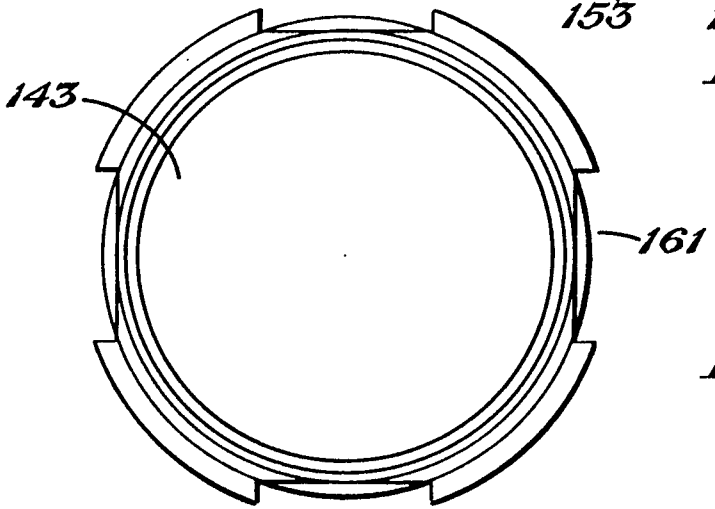

Referring to FIGS. 14 and 15, the upper sub 141U is formed of steel and has a central aperture 143 formed therethrough with female threads 145 which mate with the threads 105 of the casing members 101U and 101L such that an end 101UB of the casing member 101U may be screwed into the threads 105 of the upper sub 141U until its edge butts against an inside annular lug 147 of the upper sub 141U as shown in FIG. 1B. The inside of the upper sub 141U next to the threads 145 carries a seal 148 which engages the casing 101U when screwed in place.

The outside of the upper sub 141U is cylindrical in shape and is machined to form two cylindrical slots 151 and 153 with larger diameter portions 155 and 157 left at one end 141UA and at an intermediate position. Male threads 159 are formed at the other end. Four angularly spaced slots 161 are machined in the enlarged portions 155 and 157 as shown in FIG. 15. The four slots 161 of enlarged portions 155 and 157 are in alignment respectively. A hollow steel cylindrical shaped body 251 is provided in which the upper sub 141U is located. The body 251 has four angularly spaced apart apertures 253 formed therethrough and eight angularly spaced apart apertures 255 formed therethrough.

Four angularly spaced apart apertures 163 are formed through the wall of the upper sub 141U at the enlarged portions 157 in alignment with apertures 253 for receiving four detents assembles 165. Referring to FIG. 18, each of the apertures 163 has an enlarged diameter portion at the outside which is threaded and a smaller diameter portion 167 at the inside. Each detent assembly 165 comprises a round member 171 with an annular O-ring seal 173 adapted to fit in one of the apertures 253 and an annular wall 174 having an open cavity 175 for receiving a spring 177 and a detent 170 having an end which extends through aperture portion 167. The spring 177 urges the detent 179 inward. The outside of the annular wall 174 has threads whereby it may be screwed to the threads of the aperture 163 for holding the assembly in place. Member 181 is an annular O-ring seal.

Figure 10:
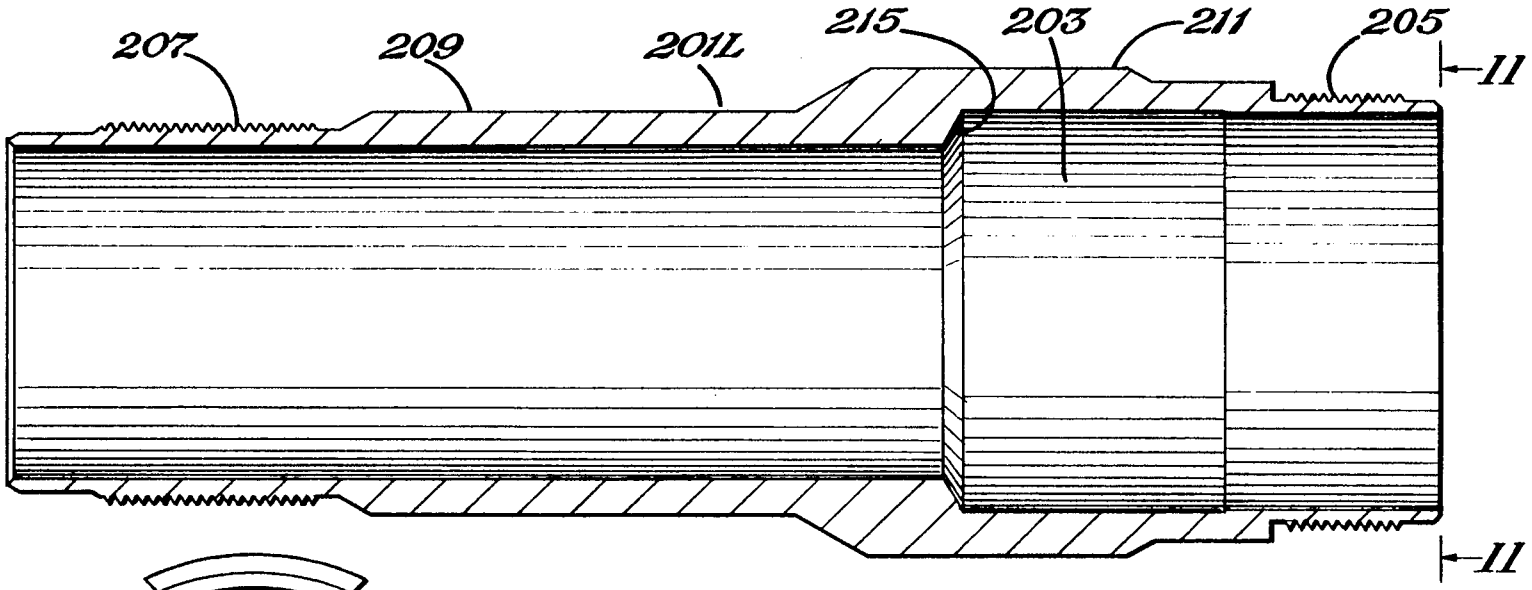
FIG. 10 is an enlarged cross section of the lower sub of the completion tool.
Figure 11:
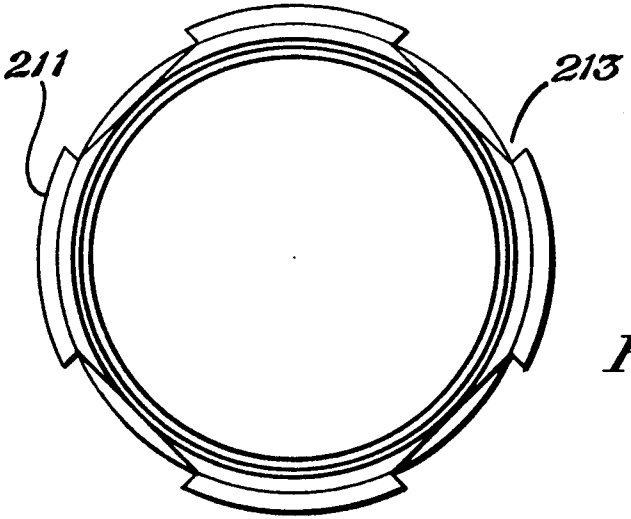
FIG. 11 is an end view of the lower sub of FIG. 10 taken along the lines 11—11 thereof.

Referring to FIGS. 10 and 11 the lower sub 201L is a steel member having a central aperture 203 formed therethrough. The lower sub 201L is formed from a cylindrical member with male threads 205 and 207 formed at opposite ends. The cylindrical member is machined to form a smaller diameter cylindrical portion 209 leaving a larger outside diameter portions 211 in which are cut four angularly spaced apart slots 213. The inside diameter of portion 211 is larger than the inside diameter of portion 209 with a shoulder 215 formed therebetween.

Figure 13:
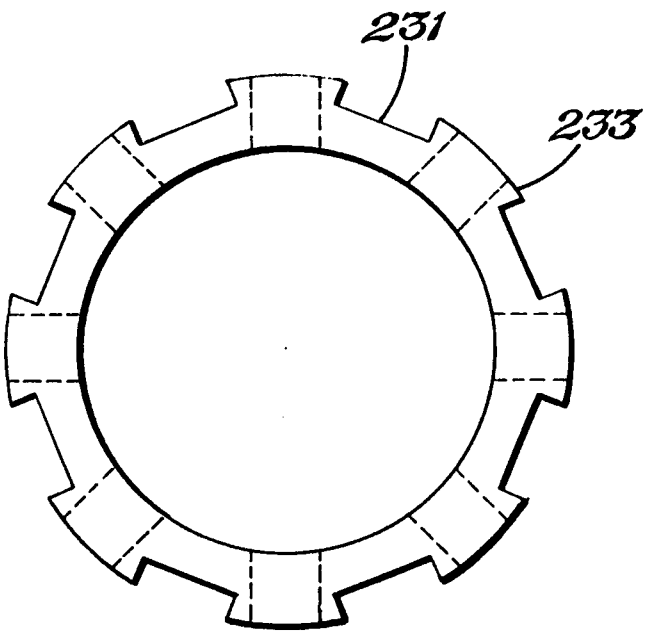
FIG. 13 is an end view of the inner coupling member of FIG. 12 taken along lines 13—13 thereof.
Figure 12:
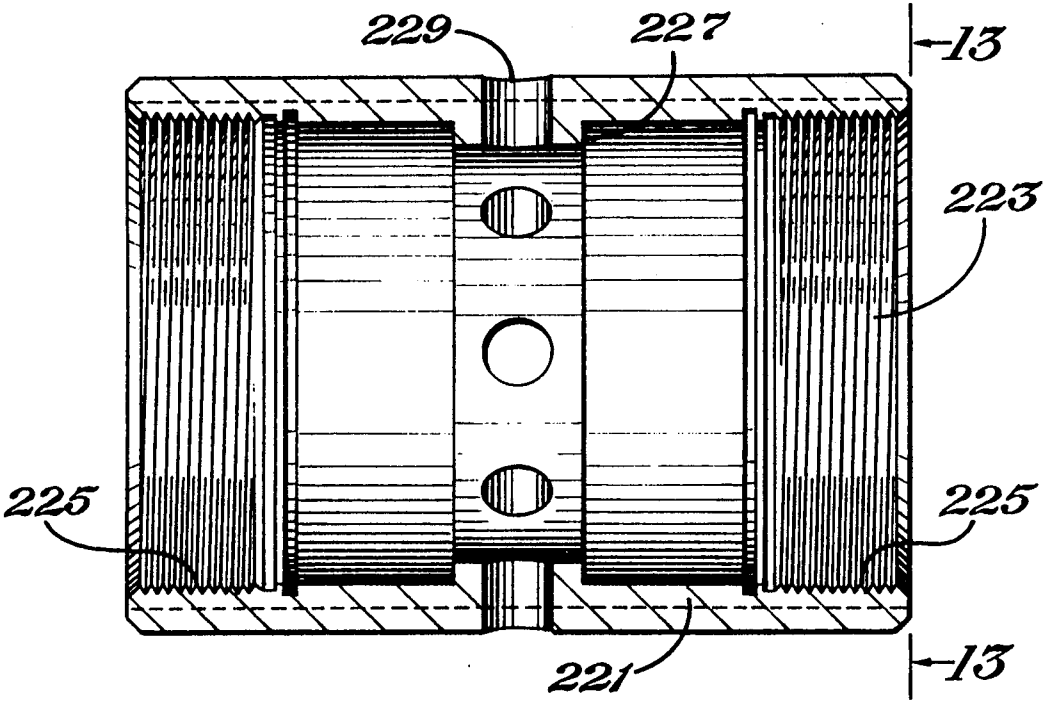
FIG. 12 is an enlarged cross section of the inner coupling member of the completion tool.

Referring to FIGS. 12 and 13 the inner coupling member 221 employed to connect the upper and lower subs 141U and 201L together is formed of steel and has an opening 223 formed therethrough. It has female threads 225 formed in each end and an annular inward extending lug 227 through which are formed eight angularly spaced apart production ports 229. Eight angularly spaced apart slots 231 are cut in the outside of the cylindrical surface of the member 221 along its length forming eight angular spaced apart spokes 233. The apertures 229 are formed through the spokes 233. The threads 159 and 205 of the upper and lower subs 141U and 201L are screwed into the threads 223 of the inner coupling member 221, and the assembly 141U, 221 and 201L is fitted in the outer body 251 with the apertures 229 in alignment with apertures 255. Annular flexible seals 235 (with metal backups) and resilient O-rings 237 are supported between the lug 227 and the ends of the subs 141U and 201L. The inner coupling member 221 also supports annular seals 239.

Figure 1C:
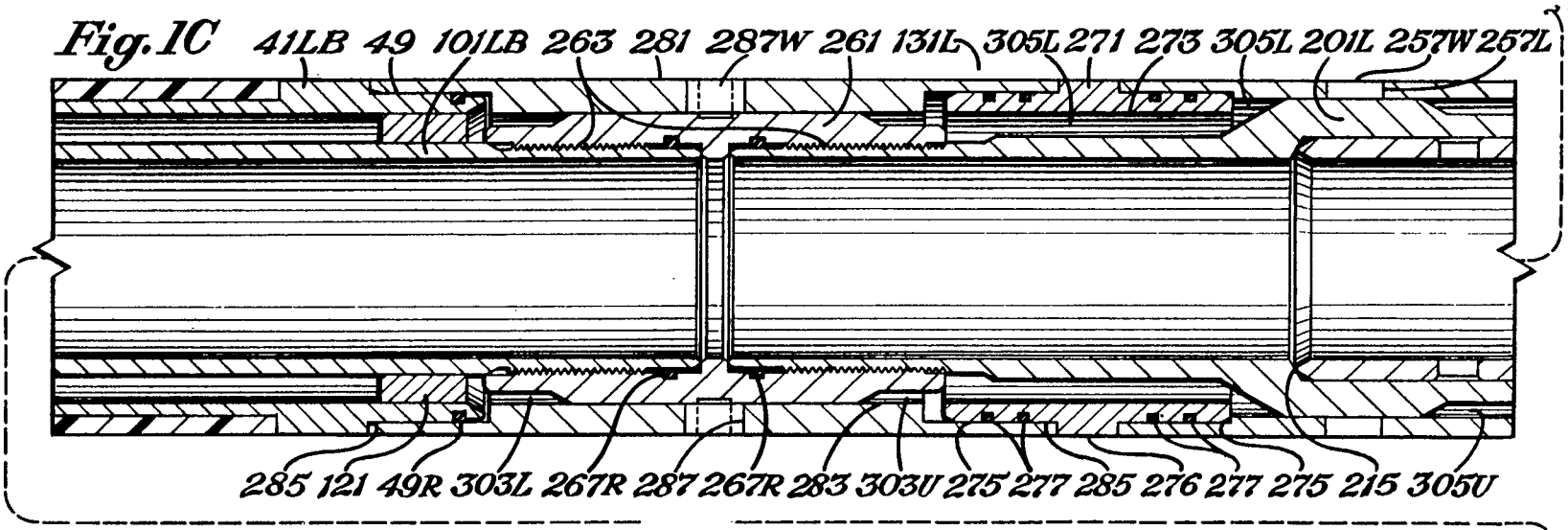
Figure 1D:
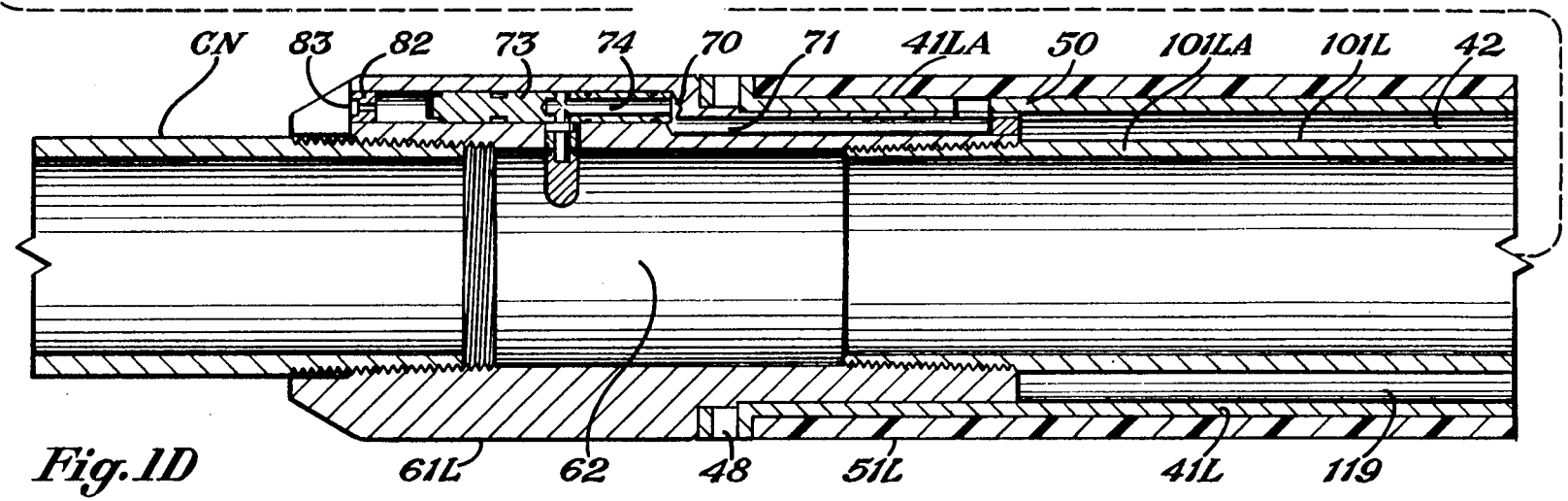

The inside diameters of subs 141U and 201L and inner coupling member 221 between lug 147 of sub 141U and shoulder 215 of sub 201L are the same and supports a cylindrical piston 241 for sliding movement between a closed position as shown in FIGS. 1B and 1C and an open position where its end 241L abuts against the lug 147. Referring also to FIGS. 16 and 17 the piston 241 is formed of steel and has a central opening 243 formed therethrough. Eight angularly spaced apart ports 245 are formed through the wall of the piston 241 near its end 241L. The inside wall of the piston has annular profile slots 247 and 247A formed therein and the outside wall of the piston has two groups of angularly spaced apart detent slots 249L and 249U formed therein. In the closed position of the piston, detents 179 are located in slots 249U and releasably hold the piston such that its ports 245 are spaced from the ports 229 and 255 of the inner coupling member and outer body 251 and the seals 235, 237 block passage of fluid into the piston through ports 229 and 255. Gripping members (shifting blocks) inserted into the piston from above are employed to pull the piston up to move the detents 179 out of slots 249U and into slots 249L to an open position where its end 241U abuts lug 147 and piston ports 245 are aligned with ports 229 and 255 of the coupling member 221 and outer body 251 allowing fluid flow into the piston by way of ports 255,229 and 245. The piston 241 has a slot 250 longitudinally formed in its outer surface between slots 249U and 249L in which one of the detents 179 is located when the piston is moved between its open and closed position to prevent the piston from rotating. The shifting tool also can be used to move the piston from its open position to its closed position.

The sub-assembly comprising the inflation valve body 61L, and its components, the casing 101L, the packer mandrel 41L the packer 51L and centralizing ring 121 is exactly the same as the sub-assembly comprising the valve body 61U and its components, the casing 101U, the packer mandrel 41U, the packer 51U and the centralizing ring 121. The sub-assembly comprising members 61L, 101L, 41L, 51L, and 121 is coupled to the lower sub 201L by turning it around and screwing the threads 105 of the casing 101L at end 101LB to the female threads 263 at one end of the adapter coupling 261 with the female threads 263 at the other end of the adapter coupling 261 screwed to the threads 207 of the lower sub 201L. Prior to this connection the seal ring 271 is located around the smaller diameter portion 209 of the lower sub 201L and the by-pass mandrel 281 is located around the adapter coupling 261.

Figure 9:
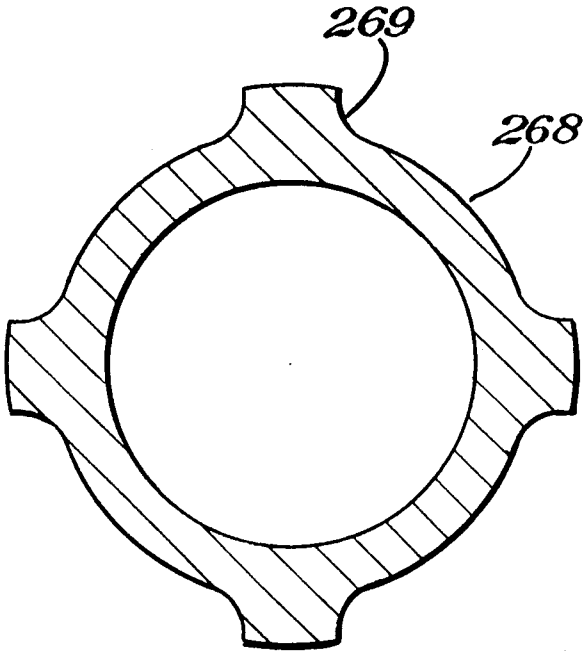
FIG. 9 is an end view of the adapter coupling member of FIG. 8 taken along the lines 9—9 thereof.
Figure 8:
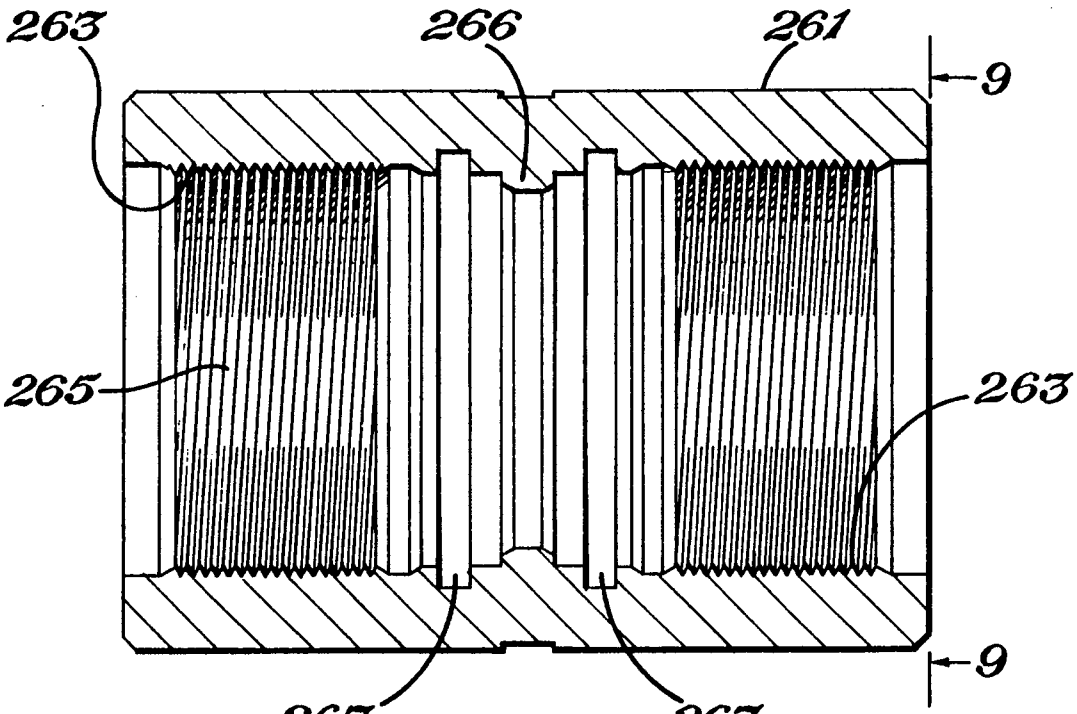
FIG. 8 is an enlarged cross section of an adapter coupling member of the completion tool.

Referring to FIGS. 8 and 9, the adapter coupling 261 is a cylindrical steel member having a central opening 265 formed therethrough with female threads 263 formed in opposite ends. It has an intermediate inwardly extending lug 266, against which the ends of the casing 101LB and lower sub 201L abut when screwed in place. The coupling 261 has two annular slots 267 formed on opposite sides of the lug 266 for holding O-ring seals 267R. Four angularly spaced apart slots 268 are machined in the cylindrical outer surface of the coupling forming four angularly spaced apart spokes 269. The slots 268 and spokes 269 extend along the length of the coupling 261. The adapter coupling 261 of FIG. 8 does not have the smaller outside diameter end portions as shown in FIG. 1C, however, if desired, smaller outside diameter and portions can be formed in the adapter coupling of FIG. 8.

The seal ring 271 is a steel cylindrical shaped member having a central opening 273 extending therethrough. It has two outer smaller diameter portions 275 on opposite sides of a larger diameter portion 276. Portions 275 each carry two O-rings seals 277.

The by-pass mandrel 281 is a steel member having a central opening 283 formed therethrough. The inside diameter 285 at the ends are larger such that one end may be located around surface 49 of the packer mandrel 41LB and the other end may be located around one end surface 275 of the seal ring 271. The lower end of the lower sub 201L is located around the other end surface 275 of the seal ring 271.

In assembling the completion tool, the component parts are fitted and screwed together as shown in FIGS. 1A–1D. The outer body 251 has a plurally of angularly spaced apart upper and lower apertures 257U and 257L formed through the wall thereof whereby the outer body 251 may be welded to the enlarged portions 155 and 211 of the upper and lower subs 141U and 201L as illustrated by welds 257W. The by-pass mandrel 281 also has a plurally of angularly spaced apart apertures 287 formed therethrough whereby it may be welded through apertures 287 to the outer surface of the adapter coupling 261 after the components of the tool are screwed and fitted together. The ring seal 271 may be tack welded to the ends of the lower sub 201L and the by-pass mandrel 281.

When the completion tool is fitted and screwed together, the central aperture CA formed through the tool is defined by opening 62 of the upper inflation valve body 61U, opening 103 of the upper casing 101U, opening 143 of the upper sub 141U, opening 243 of the piston 241, opening 223 of the inner coupling 221, opening 203 of the lower sub 201L, opening 265 of the adapter coupling, opening 103 of the lower casing 101L and opening 62 of the lower inflation valve body 61L.

An outer flow path through the completion tool also is formed when the tool is fitted and screwed together. The outer flow path is defined by the openings 48 formed through the lower end of the lower packer mandrel 41L; the slots 92 of the lower inflation valve body 61L; the annulus 119 formed between the lower casing 101L and the lower packer mandrel 41L; slots 125 formed in the lower centralizing ring 121; annulus 303L, slots 268, and annulus 303U formed between the adapter coupling 261 and the by-pass mandrel 281; annulus 305L, slots 213 and annulus 305U formed between the lower sub 201L and the seal ring 271 and the outer body 251; slots 231 formed in the inner coupling 221; annulus 307L, slots 161, annulus 307U, and slots 161, formed between the upper sub 141U and the outer body 251; slots 125 formed in the upper centralizing ring 121; annulus 119 formed between the upper casing 101U and the upper packer mandrel 41U; slots 92 formed in the upper inflation valve body 61U; and openings 48 formed through the upper end of the upper packer mandrel 41U.

Referring to FIG. 19, there is disclosed an extension assembly which may be fitted and secured to the tool between the two packers to extend the length of the tool and the distance between the packers. The extension assembly is formed from an outer body 251 having located therein an adapter coupling members 261, a casing member 101, a centralizing ring 121, and a seal ring 271. The casing 101 has one end screwed into the adapter coupling member 261 located in one end of the body 251 and its other end extending out of the other end of the body 251. The other end of the body 251 has the centralizing ring 121 located therein and around the casing 101 and the ring seal 271 located therein and extending partially outward thereof. The body 251 of FIG. 19 does not have the apertures 253 and 255 formed therethrough. The extension assembly of FIG. 19 may be attached in the tool between the packer 51L and the adapter coupling 261 by screwing the other female threads 263 of the adapter coupling member 261 of the assembly to the threads formed in the casing member 101LB and by screwing the outward extending threads of the casing 101 of the assembly to the threads 263 of the adapter casing 261 in the tool. The body 251 of FIG. 19 is then welded to the centralizing ring 121 and the adapter coupling 261 of the assembly of FIG. 19 through the apertures 257U and 257L. The extension assembly of FIG. 19 also can be coupled to the completion tool on the other side of the sleeve valve 131 by screwing the outwardly extending threads of the casing 101 of FIG. 19 into the female threads formed at the upper end of the upper sub 141U and by screwing the female threads of the adapter coupling member FIG. 19 to the threads 105 of the casing 101U of FIG. 1B. After this is done, the body 251 of the assembly will be welded to its centralizing ring and adapter coupling through the apertures 257U and 257L.

In using the completion tool a lower casing string member CN will be screwed into the lower inflation valve body 61L as shown in FIG. 1D and an upper casing string will be screwed into the upper inflation valve body 61U. The completion tool is inserted into a borehole such that the lower inflation valve body 61L extends downward and the tool then is lowered by way of the upper casing string to an estimated position of interest in the borehole to locate the packers above and below the formation to be produced. The exact position can be determined by running a gamma ray collar log through the casing and through the tool. The log will be recorded to determine the changes in the formations and in the metal thickness of the tool so one can identify the different parts of the tool and where it is in the borehole. Once the exact position is found, the gamma ray logging tool is removed and the packers are inflated to expand them against the borehole wall to secure the tool in the borehole with the packers located below and above the formation to be produced. The bottom end of the casing below the completion tool may have openings and structure for receiving a pump-down plug as disclosed in FIGS. 1C and 2C of U.S. Pat. No. 3,865,188, which patent is hereby incorporated herein by reference. The pump-down plug is pumped down the casing through the completion tool shearing off the covers 91 from the inflation valves of members 61U and 61L. The pump down plug comes to rest in a lower receptacle plugging the bottom of the casing. The piston 241 of the completion tool is in its closed position. Fluid such as water or mud is then pumped down the casing and into the completion tool which inflates the packers 51U and 51L through apertures 90, 72, 75, 74, bore 70*s* and apertures 85 and 50. When the pressure increase, to a preset value, for example to 300 psi, the shear pins 80 break causing pistons 73 to move against plugs 82 and blocking the flow of fluid into the packers. Thereafter pressure can be increased up to 600–1,000 psi causing a disc to shear in the pump down plug, to release fluid out the bottom of the casing below the completion tool and re-establish circulation in the wellbore.

A cement slurry is pumped down through the center of the casing, the completion tool, and the lower portion of the casing string with water or mud with a wiper plug between the water or mud and the cement. The cement then moves downward in the borehole and upward and through the outer flow path through the completion tool by way of the lower and upper by-pass openings 48 such that the cement slurry is injected in the borehole below and above the lower and upper expanded packers which then hardens to permanently set the completion tool in place.

The formation can be produced by inserting a shifting tool through the casing and into the central portion of the completion tool in the piston 241 which latches into the piston profile slot 247A to move the piston 241 to an open position to allow fluid (oil and/or gas) to be produced from the formation into the piston 241 and tool by way of apertures 255, 229, and 245 of the piston which flows upward through the piston and the completion tool and to the surface by way of the casing string. The production ports 245 of the piston can be closed by inserting the shifting tool into the completion tool until it latches into the profile slot 247A whereby then it will be lowered to move the piston to its closed position blocking the ports 255 and 229. Slot 247 are for a wireline shifting tool (electric motorized tool) and slot 247A is for a tubing shifting tool.

Thus as could be understood, the completion tool of the invention has advantages since the component parts can be readily screwed together to the exact positions to form the tool with a minimum of welding. The ends of the packers are bonded in the annular slots of the packer mandrels such that they do not slide up and down and are inflated merely by applying fluid pressure to the interior of the packers by way of the bores 70 and 71 and the apertures of the pistons 73 of the inflation valve bodies and the other apertures described. The inflation valve bodies are machined out of a single piece of steel except for their pistons and have great strength with a minimum of welding. The inflation valve bodies also serve as centralizers for the tool when the tool is initially located in the borehole. The detents 179 provide a unique way of holding the piston 241 in its open or closed position, and yet prevent the piston from rotating while it is being moved to its open and closed positions. In addition, the pressure of the detents can be varied by screwing in or out the detent assembly, whereby the piston shifting force is predetermined and set. Since the inflation valve bodies 61 and the casing members 101 and the packer mandrels 41 and packers 51 are identical, they can be used at either end of the tool. They can be used at the lower end of the tool by use of the adapter coupling member 261 as described previously. The tool is initially located in the borehole with a gamma ray collar log on a wireline operated by a hoist, however once it is set in place with the cement, the piston 241 can be opened or closed with a wireline shifting tool or a mechanical shifting tool on tubing. Use, of the stationery seals 235, 237 in the inner coupling 221 has advantages, in that more effective sealing can be obtained by having the seals stationery (completely trapped behind the piston 241 with minimum escape area exposed to the seals) rather than movable, for example, if they were carried by the piston 241 across the undercut area 431 of FIGS. 20 and 21 exposed to more debris and open escape area.

Referring now to FIGS. 20 and 21, there will be described a modified sleeve valve housing for supporting the piston 241. The modified housing comprises an elongated hollow cylindrical shaped member 401 and two end coupling members 403 and 405. Member 401 has a central opening 407 formed therethrough between ends 401L and 401U for supporting the piston 241 for sliding movement therein. The piston 241 is the same as described previously except that the slot 250 is eliminated and wiper rings 241R are employed in annular slots formed in the outer surface of the piston 241 at both ends. Outer threads 409 and 411 are formed at ends 401L and 401U of members 401.

Lower coupling member 403 is a hollow cylindrical member with a central opening 413. It has inner threads 415 at one end for coupling to threads 409 of member 401 and outer threads 417 at its opposite end for coupling to threads 263 of member 261.

Upper coupling member 405 is a hollow cylindrical member having a central opening 419. It has inner threads 421 at one end for coupling to threads 411 of member 401 and inner threads 423 at its opposite end for coupling to threads 105 of member 101U.

Members 401, 403, and 405 take the place of members 201L, 221, and 141U of FIGS. 10, 12, and 14.

An annular channel 431 is formed inside of member 401 in fluid communication with the spaced apart ports 229 thereby eliminating the need of aligning the piston 241 and its ports 245 with ports 229 as described previously with the use of the detent 179 and the slot 250 formed in the piston 241.

Enlarged portion 403A of member 403 has slots formed in its outer surface similar to slots 213 of FIG. 11 for fluid flow therethrough. Enlarged portion 401A of member 401 has slots formed in its outer surface similar to slots 231 of FIG. 13 for fluid flow therethrough. Enlarged portion 401B of member 401 has slots formed in its outer surface similar to slots 161 of FIG. 15 for fluid flow therethrough. Member 405 has slots formed in its outer surface similar to slots 161 of FIG. 15 for fluid flow therethrough.

An outer flow path for the cement slurry is formed between members 403, 401, 405 and the outer body 251 by way of the slots 213 formed in the outer surface of enlarged portion 403A of member 403; annulus 441; slots 231 formed in the outer surface of enlarged portion 401A of member 401; annulus 443, slots 161 formed in the outer surface of member 401B of member 401; annulus 445; and slots 161 formed in the outer surface of member 405.

The use of a single elongated member 401 through which the ports 229 are formed provides a stronger structure and use of the annular channel 431 eliminates the need of aligning ports 229 with ports 225. The piston 241 is shown in its closed position in FIG. 20. When the piston 241 is in its open position, ports 245 will be in line with annular slot 431 allowing fluid (oil and/or gas) to flow inward from the formation and borehole by way of ports 225 and 229, annular slot 431 and ports 245 into the piston 241.

Two annular slots 451 are formed on the inside of member 401 on each side of the ports 229 for supporting PACBAK seals 453 which in turn support O-rings 455. The seals 453 are formed of a hard rubber or elastomer.

The detent assemblies 165 are the same as described previously except steel balls 179B rather than members 179 urged inward by springs 177 are used to releasably fit in slots 249L and 249U of piston 241 to hold it in its open or closed positions. The detents primary purpose is to control the force required to open and close the sleeve 241. The shifting force is set or fixed before the tool is lowered or run in a well.

I claim:

1. A completion tool for insertion into a borehole for isolating a formation of interest traversed by the borehole, comprising:

first and second hollow packer mandrels having first and second elongated cylindrical slots respectively formed in the exterior thereof, first and second elongated cylindrical packers located in said first and second elongated cylindrical slots respectively, each packer having opposite ends bonded to the ends of the cylindrical slot in which it is located and an unbounded intermediate portion which can be expanded outward by the injection of fluid under pressure between said intermediate portion and said cylindrical slot, hollow intermediate structural means coupled between said first and second packer mandrels such that said first and second packer mandrels have upper and lower ends and said first and second cylindrical packers have upper and lower ends respectively, said hollow intermediate structural means and said first and second packer mandrels providing a central fluid flow path between said upper and lower ends of said first and second hollow packer mandrels, a hollow piston slidably located in said hollow intermediate structural means for movement between closed and open positions, outer and inner ports formed through the walls of said hollow intermediate structural means and said hollow piston respectively at positions such that said outer and inner ports are in fluid communication with each other when said piston is in said open position and closed to each other when said piston is in said closed position, an outer by-pass fluid flow path extending through said tool beyond said upper and lower ends of said first and second packer mandrels and radially outward and separate from said central fluid flow path, and means for injecting fluid under pressure between said intermediate portions of said packers and said cylindrical slots for expanding said first and second packers outward.

2. The completion tool of claim 1, comprising:

seals carried by said hollow intermediate structural means on its inside on opposite sides of said outer port for engaging said piston for forming a seal between the inside of said hollow intermediate structural means and said piston.

3. The completion tool of claim 1, comprising:

first and second spaced apart slot means formed in the exterior of said piston along its length, an aperture formed through the wall of said intermediate structural means, spring biased detent means located in said aperture formed through said wall of said hollow intermediate structural means for engaging said first and second slot means when said piston is moved to its open and closed positions respectively, for releasably holding said piston in it open and closed positions, spring means for urging said detent means inward toward the interior of said hollow intermediate structural means, and means for varying the pressure of said spring means on said detent means.

4. The completion tool of claim 2, comprising:

first and second spaced apart slot means formed in the exterior of piston along its length, an aperture formed through the wall of said intermediate structural means, spring biased detent means located in said aperture formed through said wall of said hollow intermediate structural means for engaging said first and second slot means when said piston is moved to its open and closed positions, for releasably holding said piston in its open and closed positions, spring means for urging said detent means inward toward the interior of said hollow intermediate structural means, and means for varying the pressure of said spring means on said detent means.

5. A completion tool for insertion into a borehole for isolating a formation of interest traversed by the borehole, comprising:

two substantially identical hollow metal inflation valve bodies each having a central opening with threads formed at opposite ends, two substantially identical hollow metal casing members, each having a central opening with threads formed at opposite ends, with said two casing members being screwed into ends of said two inflation valve bodies respectively such that said two inflation valve bodies form opposite ends of said completion tool, two substantially identical hollow metal packer mandrels each having opposite ends with a flexible cylindrical packer secured thereto around its outside such that intermediate portions of said packers may be expanded outward from said mandrels, said two packer mandrels being coupled to said two inflation valve bodies respectively around said casing members forming an annulus between each casing member and the packer mandrel coupled to the inflation valve body to which the casing member is screwed, each of said inflation valve bodies having slots formed in its outer surface in fluid communication with said annulus formed between said casing member and said packer mandrel to which said inflation valve body is coupled, a hollow metal adapter coupling member having a central opening with threads formed at opposite ends, hollow sleeve valve means formed of metal comprising a first type of threads formed at one end to which one of the casing members is screwed and a second type of threads formed at the other end to which one end of said adapter coupling member is screwed with the other casing member screwed to the other end of said adapter coupling member, said sleeve valve means having a central opening, a hollow piston slidably located in said central opening of said sleeve valve means for movement between closed and open positions, said piston having a central opening, outer and inner ports formed through the walls of said sleeve valve means and said piston respectively at positions such that said outer and inner ports are in fluid communication with each other when said piston is in said open position and closed to each other when said piston is in said closed position, said central opening of said two inflation valve bodies, said two casing members and said hollow sleeve valve means including said hollow piston and said adapter coupling forming a central passageway extending through said completion tool, said sleeve valve means including structure radially outward of its central opening forming an outer passageway sealed from said central passageway, said two annuluses, said outer passageway and said slots of said two inflation valve bodies forming an outer by-pass flow path through said completion tool.

6. The completion tool of claim 5, wherein:

said threads formed at said opposite ends of said two inflation valve bodies comprise female threads, said threads formed at opposite ends of said two casing members comprise male threads, lower and upper hollow metal subs each having female threads formed at one end and male threads formed at an opposite end, an inner hollow coupling member having said outer ports formed therethrough and female threads formed at opposite ends, said female threads of said upper sub being screwed to said male threads of the upper casing member, said male threads of said lower and upper subs being screwed to said female threads respectively of said inner coupling member, said threads formed at opposite ends of said adapter coupling member comprising female threads, said male threads of said lower sub being screwed to said female threads at one end of said adapter coupling member and said female threads at the other end of said adapter coupling member being screwed to said male threads of said lower casing member.

7. The completion tool of claim 6, comprising:

outer body means surrounding said upper and lower subs, and said inner adapter coupling members, said lower and upper subs and said inner and adapter coupling members comprising structure forming said outer passageway.

8. The completion tool of claim 5, comprising seals carried by said sleeve valve means on its inside on opposite sides of said outer port for engaging said piston for forming a seal between the inside of said sleeve valve means and said piston.

9. The completion tool of claim 5, comprising:

first and second spaced apart slot means formed in the exterior of said piston along its length, an aperture formed through the wall of said sleeve valve means, spring biased detent means located in said aperture formed through said sleeve valve mans for engaging said first and second slot means when said piston is moved to its open and closed positions respectively, for releasably holding said piston in its open and closed position, spring means for urging said detent means inward toward the interior of said sleeve valve means, and, means for varying the pressure of said spring means on said detent means.

10. The completion tool of claim 8, comprising:

first and second spaced apart slot means formed in the exterior of said piston along its length, an aperture formed through the wall of said sleeve valve means, spring biased detent means located in said aperture formed through said sleeve valve means on for engaging said first and second slot means when said piston is moved to its opened and closed positions, spring means for urging said detent means inward toward the interior of said sleeve valve means, and means for varying the pressure of said spring means on said detent means.

11. The completion tool of claim 6, comprising:

an extension assembly adapted to be coupled between said male threads of said lower sub and said female threads of said adapter coupling member screwed to said male threads of said lower casing member, said extension assembly comprising, an outer hollow cylindrical body having an adapter coupling member and a casing member located therein, said adapter coupling member of said extension assembly being substantially identical to said adapter coupling member screwed to male threads of said lower casing, said casing member of said extension assembly being generally identical to said two casing members.

12. The completion tool of claim 5, wherein each of said inflation valve bodies comprises:

an annular wall having a central axis, an elongated cavity formed in said annular wall generally parallel to said central axis, inlet means for providing fluid communication between the interior of said inflation valve body and said cavity, an inflation flow path formed in said annular wall for providing fluid communication between said cavity and said intermediate portion of said packer and said cylindrical slot of said packer mandrel to which said inflation valve body is coupled, an inflation piston slidably located in said cavity for allowing fluid flow, by way of said inlet means, from the interior of said inflation valve body to said inflation flow path for expanding said packer outward, until the fluid pressure between said intermediate portion of said packer and said cylindrical slot of said packer mandrel to which said inflation valve body is coupled, reaches a given level and then for blocking fluid flow from the interior of said inflation valve body to said inflation flow path.

13. A completion tool for insertion into a borehole for isolating a formation of interest traversed by the borehole, comprising:

first and second hollow packer mandrels having first and second elongated cylindrical slots respectively formed in the exterior thereof, first and second elongated cylindrical packers located in said first and second elongated cylindrical slots respectively, each packer having opposite ends bonded to the ends of the cylindrical slot in which it is located and an unbounded intermediate portion which can be expanded outward by the injection of fluid under pressure between said intermediate portion and said cylindrical slot, hollow intermediate structural means coupled between said first and second packer mandrels such that said first and second packer mandrels have upper and lower ends and said first and second cylindrical packers having upper and lower ends, said hollow intermediate structural means and said first and second packer mandrels providing a central fluid flow path between the said upper and lower ends of said first and second hollow packer mandrels, a hollow piston slidably located in said hollow intermediate structural for movement between closed open positions, outer ports formed through the wall of said hollow intermediate structural means, an annular slot formed in the inside of said hollow intermediate structural means in fluid communication with said outer ports, inner ports formed through the wall of said hollow piston at positions such that said annular slot and said inner ports are in fluid communication with each other when said piston is in said open position and closed to each other when said piston is in said closed position, an outer by-pass fluid flow path extending through said tool beyond said upper and lower ends of said first and second packer mandrels and radially outward and separate from said central fluid flow path, and means for injecting fluid under pressure between said intermediate portions of said packers and said cylindrical slots for expanding said first and second packers outward.

14. A completion tool for insertion into a borehole for isolating a formation of interest traversed by the borehole, comprising:

first and second hollow packer mandrels having first and second elongated slots respectively formed in the exterior thereof, first and second elongated cylindrical packers located in said first and second elongated cylindrical slots respectively, each packer having opposite ends secured to the ends of the cylindrical slot in which it is located and an unsecured intermediate portion which can be expanded outward by the injection of fluid under pressure between said intermediate portion and said cylindrical slot, first and second hollow inflation valve bodies each having a central opening extending therethrough, first and second hollow casing members each having a central opening extending therethrough, said first and second casing members being coupled to said first and second inflation valve bodies respectively such that said central openings of said first and second casing members are in fluid communication with said central openings of said first and second inflation valve bodies respectively, said first and second packer mandrels being coupled to said first and second inflation valve bodies respectively around said first and second casing members respectively forming first and second annuluses between said first and second casing members and said first and second packer mandrels, hollow intermediate structural means coupled between said first and second packer mandrels and between said first and second casing members respectively, said intermediate structural means having a central opening formed therethrough in fluid communication with said central openings of said first and second casing members and an outer by-pass fluid flow path radially outward and separate from said central flow path with said outer by-pass fluid flow path being in fluid communication with said first and second annuluses, each of said inflation valve bodies having slots formed in its outer surface in fluid communication with said annulus formed between said casing member and said packer mandrel to which said inflation valve body is coupled, a hollow piston slidably located in said central opening of said intermediate structural means for movement between closed and open positions, said piston having a central opening extending therethrough, at least one outer port formed through the wall of said intermediate structural means at a position such that said outer port is in fluid communication with said central opening of said piston when said piston is in said open position and closed to said central opening of said piston when said piston is in said closed position, each of said inflation valve bodies comprising, an annular wall having a central axis, an elongated cavity formed in said annular wall generally parallel to said central axis, inlet means for providing fluid communication between the interior of said inflation valve body and said cavity, an inflation flow path formed in said annular wall for providing fluid communication between said cavity and said intermediate portion of said packer and said cylindrical slot of said packer mandrel to which said inflation valve body is coupled, an inflation piston slidably located in said cavity for allowing fluid flow, by way of said inlet means, from the interior of said inflation valve body to said inflation flow path for expanding said packer outward, until the fluid pressure between said intermediate portion of said packer and said cylindrical slot of said packer mandrel to which said inflation valve body is coupled, reaches a given level and then for blocking fluid flow from the interior of said inflation valve body to said inflation flow path.

15. The completion tool of claim 14, comprising:

seals carried by said hollow intermediate structural means on its inside on opposite sides of said outer port for engaging said piston for forming a seal between the inside of said hollow intermediate structural means and said piston, at least one inner port formed through the wall of said piston at a position such that said inner and outer ports are in fluid communication with each other when said piston is in said open position and closed to each other when said piston is in said closed position.

16. The completion tool of claim 14, comprising:

first and second spaced apart slot means formed in the exterior of said piston along its length, an aperture formed through the wall of said intermediate structural means, spring biased detent means located in said aperture formed through said wall of said hollow intermediate structural wall for engaging said first and second slot means when said piston is moved to its open and closed positions respectively, for releasably holding said piston in its open and closed positions, spring means for urging said detent means inward toward the interior of said hollow intermediate structural means, and means for varying the pressure of said spring means on said detent means.

17. The completion tool of claim 16, wherein:

said spring biased detent means comprises a ball.

18. The completion tool of claim 15, comprising:

first and second spaced apart slot means formed in the exterior of said piston along its length, an aperture formed through the wall of said hollow intermediate structural means, spring biased detent means located in said aperture formed through said wall of said hollow intermediate structural means for engaging said first and second slot means when said piston is moved to its open and closed positions respectively, for releasably holding said piston in its open and closed positions, spring means for urging said detent means inward toward the interior of said hollow intermediate structural means, and means for varying the pressure of said spring means on said detent means.

19. The completion tool of claim 16, wherein:

said hollow intermediate structural means comprise a single sleeve member.

20. The completion tool of claim 14, wherein:

said first and second packer mandrel are substantially identical, said first and second casing members are substantially identical, said first and second inflation valve bodies are substantially identical.

21. The completion tool of claim 16, wherein:

said first and second packer mandrels are substantially identical, said first and second casing members are substantially identical, said first and second inflation valve bodies are substantially identical.

22. The completion tool of claim 19, wherein:

said first and second packer mandrels are substantially identical, said first and second casing members are substantially identical, said first and second inflation valve bodies are substantially identical.

* * * * *